US005986625A

United States Patent [19]

Huang et al.

[11] Patent Number: 5,986,625

[45] Date of Patent: Nov. 16, 1999

[54] APPLICATION SPECIFIC FIELD EMISSION DISPLAY INCLUDING EXTENDED EMITTERS

[75] Inventors: Karen Huang; Christophe Pierrat, both of Boise, Id.

[73] Assignee: Micron Technology, Inc., Boise, Id.

[21] Appl. No.: 08/779,616

[22] Filed: Jan. 7, 1997

[51] Int. Cl.[6] ..... G09G 3/22

[52] U.S. Cl. ..... 345/74; 345/44

[58] Field of Search ..... 345/74, 76, 77, 345/79, 915, 44; 313/309, 495, 336, 169.3; 445/24

[56] References Cited

U.S. PATENT DOCUMENTS

| | | | |
|---|---|---|---|
| 4,898,557 | 2/1990 | Engemann | 445/49 |
| 5,100,355 | 3/1992 | Marcus et al. | 445/24 |
| 5,151,061 | 9/1992 | Sandhu | 445/24 |
| 5,162,704 | 11/1992 | Kobori et al. | 315/349 |
| 5,199,917 | 4/1993 | MacDonald et al. | 445/24 |
| 5,408,161 | 4/1995 | Kishino et al. | 313/495 |
| 5,558,554 | 9/1996 | Finklea et al. | 445/52 |
| 5,729,244 | 3/1998 | Lockwood | 345/74 |

OTHER PUBLICATIONS

Lee, B.; Elliott, T.S.; Mazumdar, T.K.; McIntyre, P.M.; Pang, Y.; Trost, H.–J. "Knife–Edge Thin Film Emission Cathodes on (110) Silicon Wafers," *IVMC 1993 Meeting Abstract*, pp. 56–57, 1993.

Kanemaru, S.; Ochiai, H.; Itoh, J. "Fabrication of a New Vertical–Wedge Silicon Field Emitter Array," *Revue "Le Vide, les Couches Minces"* Suppl. No. 271: 213–216, 1994.

*Primary Examiner*—Steven J. Saras
*Assistant Examiner*—Fritz Alphonse
*Attorney, Agent, or Firm*—Seed and Berry LLP

[57] ABSTRACT

An application specific field emission display includes one or more extended emitters. The emitters are patterned according to a selected image where the selected image depends upon the application. In one embodiment, an emitter is patterned in a serpentine pattern to provide a single block of illumination. In another application, emitters are grouped in threes and the emitters are driven respectively by the red, green, and blue components of an image signal to produce a multicolor display. In a display assembly according to the invention, application specific emitters are incorporated in subdisplays on a common substrate with a conventional matrix addressable array. The array provides video, graphical or textual information and the subdisplays provide textual, fixed-shaped graphical, numerical or colorized information.

29 Claims, 2 Drawing Sheets

APPLICATION SPECIFIC FIELD EMISSION DISPLAY INCLUDING EXTENDED EMITTERS

STATEMENT AS TO GOVERNMENT RIGHTS

This invention was made with government support under Contract No. DABT-63-93-C-0025 by Advanced Research Projects Agency (ARPA). The government has certain rights to this invention.

TECHNICAL FIELD

The present invention relates to field emission displays and, more particularly, to field emission displays having extended emitter structures.

BACKGROUND OF THE INVENTION

Flat panel displays are widely used in a variety of applications, including computer displays. One suitable flat panel display is a field emission display. Field emission displays typically include a generally planar emitter panel beneath a display screen. The emitter panel is a substrate having an array of surface discontinuities projecting from an upper surface. Conventionally, the surface discontinuities are conical projections, or "emitters" integral to the substrate. Contiguous groups of emitters are then grouped into emitter sets where the bases of the emitters in the emitter sets are commonly connected.

Typically, the emitter sets are arranged in an array of rows and columns, and a conductive extraction grid is positioned above the emitters. All, or a portion, of the extraction grid is driven with a voltage of about 30–120 V. The emitter sets are then selectively activated by applying a voltage to the emitter sets. The voltage difference between the emitter sets and the extraction grid produces an electric field extending from the extraction grid to the emitters. In response to the electric field, the emitter sets emit electrons.

The display screen is mounted directly above the extraction grid and is coated with a transparent conductive material to form an anode biased to about 1–2 kV. The anode attracts the emitted electrons, causing the electrons to pass through the extraction grid. A cathodoluminescent layer covers the anode and faces the extraction grid to intercept the electrons as they travel toward the 1–2 kV potential of the anode. The electrons strike the cathodoluminescent layer, causing the cathodoluminescent layer to emit light at the impact site. The emitted light then passes through the anode and display screen where it is visible to a viewer. The light emitted from each of the areas thus becomes all or part of a picture element or "pixel."

The brightness of the light produced in response to the emitted electrons depends, in part, upon the rate at which electrons strike the cathodoluminescent layer, which in turn depends upon the available current providing electrons to the emitter sets. The light intensity of each pixel is controlled by controlling the current available to the corresponding emitter set. To allow individual control of each of the pixels, each emitter set is selectively controlled by a row signal and column signal through corresponding drive circuitry. To create an image, the control circuitry separately establishes current to each of the emitter sets. Because a typical display includes several thousand pixels, the control circuitry must be able to separately address each of the emitter sets. Consequently, such field emission displays typically require relatively complex control circuitry and tightly controlled signal timing.

A further drawback of conventional field emission displays is that electrons are emitted from the points of the conical emitters which have very small cross-sectional areas. If electrons are extracted too quickly from the emitters, the resulting high current density within the emitters could damage the emitters. Thus, the rate at which electrons can be emitted must be limited, thereby limiting brightness of the pixels.

To try to overcome the problem of low current capability and to increase reproducibility, Kanemaru et al. demonstrated a segmented vertical-wedge emitter panel in Kanemaru, Ochiai, and Itoh, "Fabrication of a New Vertical Wedge Silicon Field Emitter Array," *Revue: Le Vide, les Couches Minces*, Suppl. No. 271, March–April 1994 (International Vacuum Manufacturing Conference 1994), which is incorporated herein by reference. Kanemaru et al. proposed an array of short, wedge-shaped emitters arranged in rows and columns. The wedge-shaped emitters act as substitutes for conical emitters and would presumably require similarly complex control circuitry.

SUMMARY OF THE INVENTION

An application specific field emission display includes an extended emitter having a linear emissive discontinuity that follows a selected image pattern. In one embodiment, the extended emitter projects from an emitter substrate with a triangular elevational cross section. The emitter extends along the emitter substrate such that the apex of the emitter forms a contiguously extending discontinuity. An extraction grid extends alongside the emitter and a transparent anode is positioned above the emitter. The extraction grid is biased to about 30–120V and the anode is biased to about 1–2 kV.

An n+ region beneath the emitter allows the emitter to be connected to a reference potential, such as ground. The voltage difference between the extraction grid and the grounded emitter produces an intense electric field extending from the extraction grid to the emitter. The electric field extracts electrons high anode voltage draws the extracted electrons upwardly. The electrons strike a cathodoluminescent layer covering the anode, causing the cathodoluminescent layer to emit light. Because the light emitting region is an extended strip following the pattern of the extended emitter, light is emitted according to the selected pattern.

In one embodiment, the display includes several parallel extended emitters grouped in threes where the three emitters in each group are driven by red, green, and blue signal components, respectively. In this embodiment, a cathodoluminescent layer is segmented into red, green, and blue strips, each aligned to a corresponding extended emitter. A range of colors can be produced by selectively activating one or more of the emitters in each set.

In another embodiment of the display, the extended emitter is formed in a serpentine shape to emit light over a contiguous block. The extended emitter is driven by a single signal to selectively control the intensity of the region.

In another embodiment of the display, a first region of the display includes a conventional array of emitter sets and remaining regions of the display are formed from extended emitters. The conventional array of emitter sets is used to display video or graphical information. The regions containing extended emitters display application-specific images, such as warning images or symbols, multi-segment displays, multicolor lighting, warning or backlit text.

DETAILED DESCRIPTION OF THE INVENTION

Figure 1:
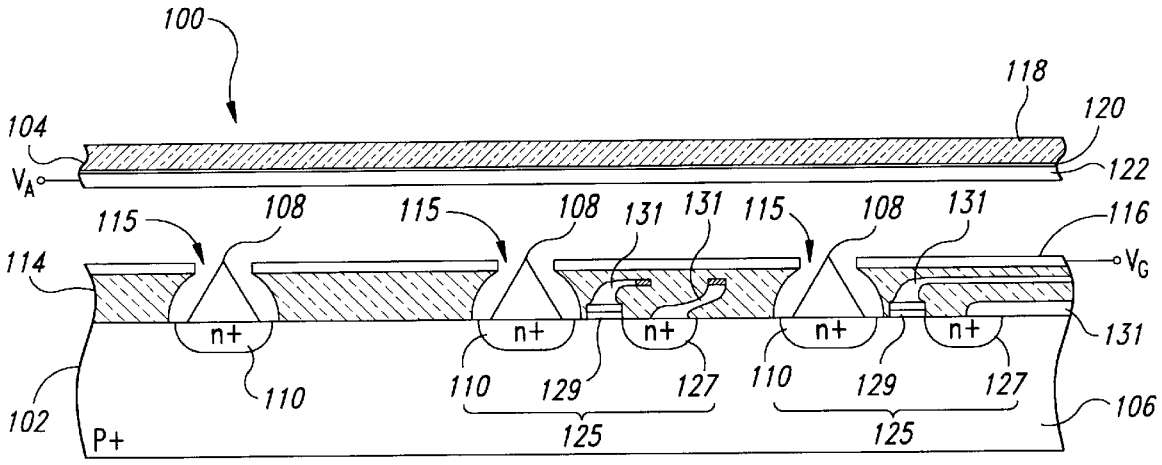
FIG. 1 is a side cross-sectional view of a portion of a field emission display according to the invention showing three spaced apart emitters beneath a screen.

As shown in FIG. 1, a field emission display 100 includes an emitter panel 102 beneath a display screen 104. The emitter panel 102 is preferably formed on a substrate 106 of single crystal, p-type silicon with three emitters 108 projecting upwardly from the upper surface of the substrate 106. While only three emitters 108 are shown in FIG. 1 for clarity of presentation, one skilled in the art will recognize that the emitter panel 102 may include many more than three emitters 108, depending upon the application.

Figure 2:
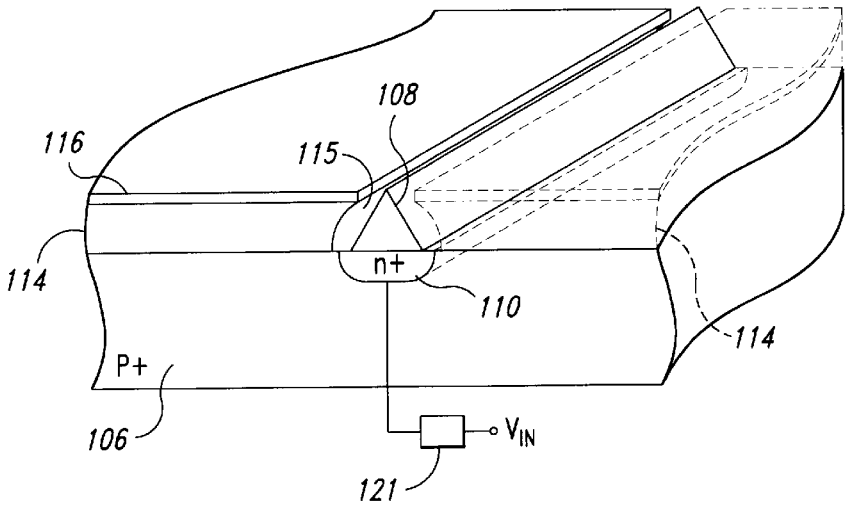
FIG. 2 is a detail isometric view of a portion of the field emission display of FIG. 1 showing one of the emitters with a portion of the extraction grid and insulation layer shown in shadow and a current control circuit coupled to the base of the emitter.

As best seen in FIG. 2, each of the emitters 108 has a triangular elevational cross section and extends linearly across the substrate 106. The apex of each emitter 108 forms a linear discontinuity for emitting electrons, as will be described below. The emitters 108 can be formed using conventional fabrication techniques, such as those described in Kanemaru, Ochiai, and Itoh, "Fabrication of a New Vertical Wedge Silicon Field Emitter Array," *Revue: Le Vide, les Couches Minces*, Suppl. No. 271, March–April 1994 (International Vacuum Manufacturing Conference 1994), although the inventive emitter 108 would omit Kanemaru's steps of transversely masking and etching the emitters 108 to form short segments. Alternatively, the emitter 108 could be formed according to the approach described in Lee, Elliott, Maxumdar, McIntyre, Pang and Trost, "Knife Edge Field Emission Cathodes on (110) Silicon Wafers" (International Vacuum Manufacturing Conference 1993), for producing wedge-shaped emitters for microwave amplifiers. Regardless of the fabrication technique, an n+ region 110 is formed in the substrate 106 below each emitter site before the emitter 108 is formed. The n+ region allows electrical connection to the base of the emitter 108, as will be described below.

An insulative layer 114 of a dielectric material is deposited on the substrate 106 around the emitters 108. The insulative layer 114 is a conventional dielectric material with apertures 115 into which the emitters 108 project. The upper surface of the insulative layer 114 carries a conductive extraction grid 116. The n+ regions 110, insulative layer 114, and extraction grid 116 can be formed using conventional field emission display fabrication techniques.

Returning to FIG. 1, the screen 104 is positioned above the emitters 108 and the extraction grid 116. The screen 104 includes a glass plate 118 having its inner surface coated with a conductive, transparent material to form an anode 120. A cathodoluminescent layer 122 coats the lower surface of the anode 120.

In operation, the extraction grid 116 is biased to a grid voltage $V_G$ of about 30–120 V and the anode 120 is biased at a high voltage $V_A$ such as 1–2 kV. If selected ones of the emitters 108 are connected to a voltage much lower than the grid voltage $V_G$, such as ground, the voltage difference between the extraction grid 116 and the emitters 108 produces an intense electric field between the emitters 108 and the extraction grid 116. The electric field causes the emitters 108 to emit electrons according to the Fowler-Nordheim equation. The emitted electrons are attracted by the high anode voltage $V_A$ and travel toward the anode 120 where they strike the cathodoluminescent layer 122, causing the cathodoluminescent layer 122 to emit light around their impact regions.

The impact region for each extended emitter 108 is a relatively narrow strip of the cathodoluminescent layer 112, because the emissive discontinuity of the emitter 108 is a line. The three emitters 108 of FIG. 1 therefore produce three linear strips of light. The strips of light pass through the transparent anode 120 and the glass plate 118 where they are visible to an observer.

The width of the light strips depends in part upon the separation between the emitters 108 and the screen 104 because the stream of emitted electrons will spread out as the electrons travel from the emitters 108 to the screen 104. If the screen 104 is far from the emitters 108, the stream of emitted electrons will be relatively wide, producing wide strips of light. If, on the other hand, the screen 104 is close to the emitters 108, the electrons will strike the cathodoluminescent layer 122 before they have a chance to spread. The resulting strips of light will therefore be narrow. For most single color applications, the dimensions of the display 100 are selected such that the streams of electrons overlap slightly to produce a contiguously illuminated area or "light block." For color applications, the dimensions are selected such that the streams of electrons do not overlap, as discussed below. Additionally, some displays incorporate focusing rings to improve control and/or prevent such overlap.

The intensity of light emitted by the cathodoluminescent layer 122 depends upon the total number of electrons striking the cathodoluminescent layer 122 during an activation interval. The rate at which the emitters 108 emit electrons depends, in turn, upon the current flowing to the emitters 108. Thus, the intensity of the emitted light can be controlled by controlling current flow to the emitters 108.

As presented in FIG. 2, a current control circuit 121 establishes the emitter current in response to an input voltage $V_{IN}$ which is provided from a source external to the display 100. The current control circuit 121 controls current flow to the emitters 108 by controlling the voltage of the n+ region 110 or by controlling the current available to the n+ region 110.

The control circuit 121 can be integrated into or onto the same substrate 106 with the emitter 108. For example, FIG. 1 shows two transistors 125 formed by the n+ regions 110, n+ regions 127 and gate structures 129. The n+ regions 127 form the sources of the transistors 125. The n+ regions 110 beneath the emitters 108 form the drains and the regions of substrate 106 beneath the gate structures 129 form the transistor channels. Control lines 131 pass through the insulative layer 114 to allow external control of the gate and source voltages of the transistors 125. By controlling the gate and source voltages, the amount of current flowing from the emitters 108 through the transistors 125 can be controlled, as is known. Thus, the brightness of the display 100 can be controlled through the control lines 131.

Although only the transistors 125 are represented as integrated into the substrate 106, one skilled in the art will recognize that additional components of the current control circuit 121 may also be integrated into or onto the substrate 106. Also, the current control circuit 121 can be separate from the substrate 106. One skilled in the art will also recognize several methods of controlling the current flow through the emitters 108. For example, the emitters 108 can be coupled directly to ground and the intensity of light can be controlled by locally varying the grid voltage $V_G$. Alternatively, the emitters 108 can be driven by a binary signal having a variable duty cycle.

Figure 3:
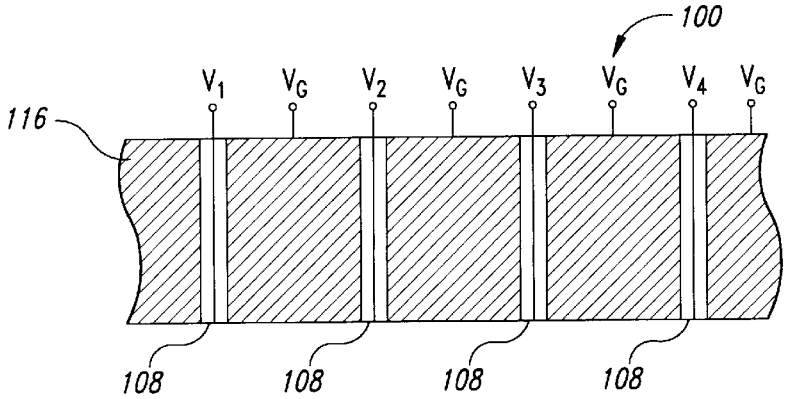
FIG. 3 is a top plan view of a portion of the field emission display of FIG. 1 showing four separate signals driving respective extended emitters.

FIG. 3 shows a section of one embodiment of the display 100 with four parallel emitters 108 driven by four separate signals $V_1$–$V_4$. The intensity of light emitted by each of the emitters 108 depends on the voltage difference between the respective signal $V_1$–$V_4$ and the grid voltage $V_G$. Because the entire extraction grid 116 is connected to the grid voltage $V_G$, the four separate signals $V_1$–$V_4$ allow separate control of illumination in the regions above the respective emitters 108. Separate control of the individual emitters 108 allows flexible control of the overall illumination pattern. For example, the four signals $V_1$–$V_4$ may be pulse width modulated to control the intensity of light in response to the input signal $V_{in}$ (FIG. 2). The amplitudes or duty cycles of the signals $V_1$–$V_4$ may then be adjusted to allow compensation for efficiency variations among the emitters 108. Similarly, each of the signals $V_1$–$V_4$ may be a component of an image signal. For example, if the image to be displayed is increasingly bright from left to right, the signals $V_1$–$V_4$, respectively, will be increasingly farther below the grid voltage $V_G$ or will be pulse width modulated with increasingly large duty cycles from left to right.

Alternatively, the left two emitters 108 can be activated by the signals $V_1$, $V_2$ while the right two emitters 108 are left inactive to illuminate only the left-hand side of the display 100. As another alternative, the first and third emitters 108 can be activated by the signals $V_1$, $V_3$. In this approach a "half-tone" can be produced with fixed voltage levels for the signals $V_1$–$V_4$. This approach advantageously allows gray-scale control where the signals $V_1$–$V_4$ are binary signals.

Figure 4:
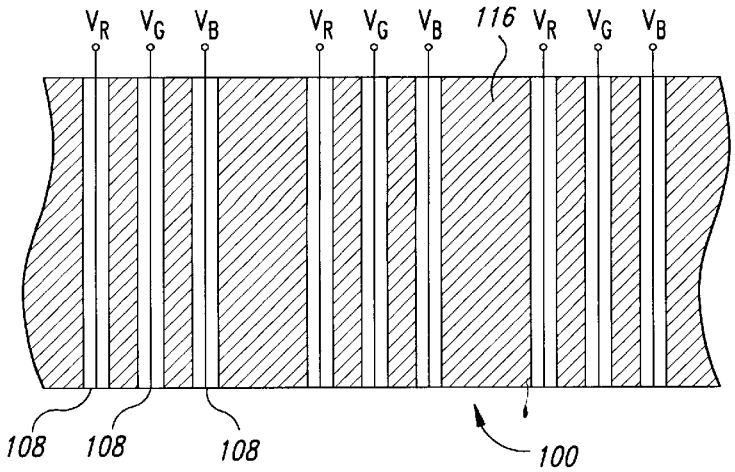
FIG. 4 is a top plan view of an embodiment of the field emission display showing extended emitters grouped in threes and driven by red, green and blue components of an image signal.

FIG. 4 shows an application of the structure of FIG. 3 in which the parallel emitters 108 are grouped in threes for color display. The three emitters in each group, are driven by the red, green, and blue components $V_R$, $V_G$, $V_B$ of an input signal. Each of the emitters 108 is aligned to a corresponding section of the cathodoluminescent layer 122 of FIG. 1 with each such section of the cathodoluminescent layer 122 containing a red, green, or blue emissive material, respectively. The red, green or blue regions of the cathodoluminescent layer 122 are then activated separately to produce red, green or blue light. As is known, red, green and blue emissive sources can be combined to produce a color display where the color is determined by the relative intensities of the red, green, and blue light levels. the display 100 of FIG. 4 can therefore be used as a multicolor display emitting various colors determined by the components $V_R$, $V_G$, $V_B$ of an input signal.

Figure 5:
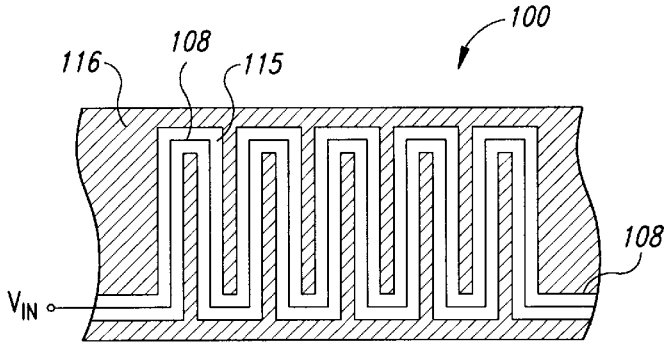
FIG. 5 is a top plan view of an embodiment of the invention having a serpentine extended emitter.

FIG. 5 presents another embodiment of the invention that allows a single emitter 108 to illuminate a "block" region. In this embodiment, the emitter 108, extraction grid 116 and aperture 115 form a serpentine emissive structure which is aligned to the cathodoluminescent layer 122 (FIG. 1). The serpentine pattern of the emitter 108 causes the emitter 108 to emit electrons along the serpentine path. The emitter electrons spread out as they travel from the block emitter 108 toward the cathodoluminescent layer 122. The block emitter 108 is sufficiently spaced from the cathodoluminescent layer 122 such that the emitted electrons from adjacent sections of the serpentine path overlap. Consequently, the emitter 108 blankets a contiguous block region of the cathodoluminescent layer 122 with a stream of electrons, causing light emission from contiguous block of the cathodoluminescent layer 122. A single input voltage $V_{in}$ can therefore produce illumination over an entire block of the display 100. While the block-illumination emitter 108 of FIG. 5 is a serpentine pattern, one skilled in the art will recognize a variety of analogous structures, including spiral emitters, concentric circles, or a variety of other geometric shapes. Also, the display 100 can incorporate the multiple parallel emitters 108 of FIG. 4 or a similar interleaved structure to produce a variable color block emitter 108 (not shown).

Figure 6:
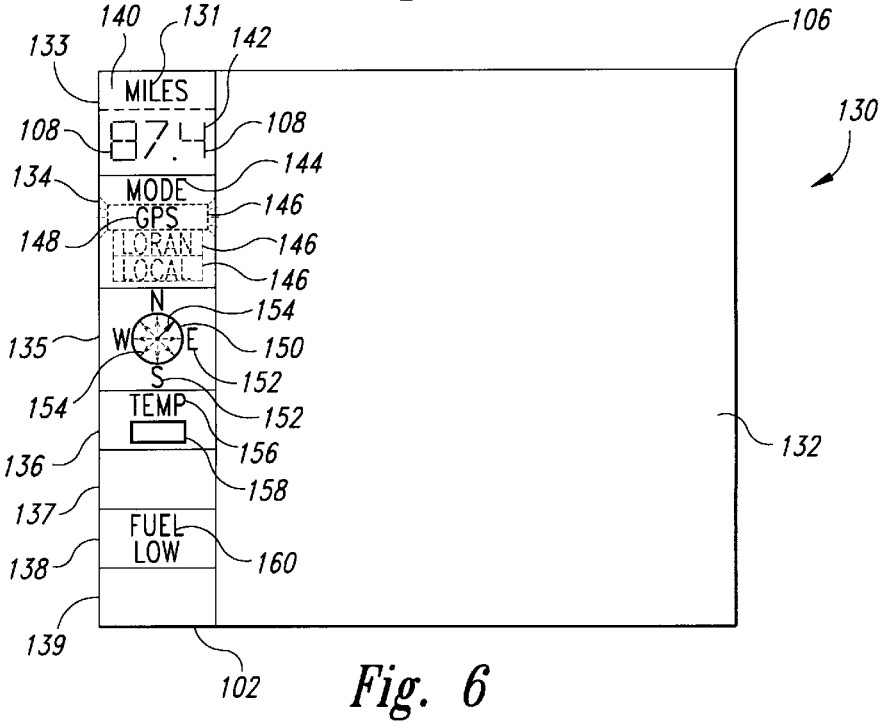
FIG. 6 is a top plan view of an embodiment of the invention including a large display conventional array of emitter sets and seven subdisplays containing extended emitters.

As shown in FIG. 6, a display assembly 130 can incorporate both extended emitters 108 and an emitter array 132 of conical emitters grouped in emitter sets. In this embodiment, the emitter array 132 and the extended emitters 108 are formed on a common substrate 106. The display assembly 130 is subdivided into a main display formed by the array 132 and seven subdisplays 133–139 formed by a variety of application specific emitters 108. The array 132 is a conventional emitter array including rows and columns of emitter sets driven by a video or similar signal. The array 132 can therefore display video images, such as a traveling map, television image, or other images representable by video or similar signals.

The subdisplays 133–139 provide application specific supplemental information. For example, a first portion 140 of the uppermost subdisplay 133 includes five separate emitters 131, each shaped into a separate letter to form the word "MILES." The first portion 140 thus provides a light emitting textual image.

Beneath the first portion 140, a second portion 142 of the subdisplay 133 provides changing numerical information from linear emitters 108 arranged according to an 11-segment display. Each of the emitters 108 is separately controlled according to conventional 11-segment display techniques to allow discrete activation of any one or more of the segments. The second portion 142 can therefore produce changing numerical information beneath the fixed textual heading of the first portion 140.

Beneath the uppermost subdisplay 133, a second subdisplay 134 includes a text-based portion 144 and three backlit portions 146 where the uppermost backlit portion 146 is active. The text-based portion 144 includes four emitters 108 similar to those described above in the first portion 140 to spell "MODE." The backlit portions 146 include block emitters 108 that, when active, provide backlighting to printed or graphical text 148. The second subdisplay 134 thus provides a combination of backlit text and/or graphical information and a fixed light emitting textual heading.

Beneath the second subdisplay 134, a third subdisplay 135 is formed from a circular emitter 150, text-shaped emitters 152 and several arrow-shaped emitters 154 to form a compass image. In the third subdisplay 135, selected ones of arrow-shaped emitters 154 can be activated to indicate direction of travel. For example, the illuminated arrow-shaped emitter 154 indicates a northeast direction of travel.

Beneath the third subdisplay 135, a fourth subdisplay 136 includes four emitters 156 shaped to spell "TEMP" and a multicolor portion 158 emitter 156 are similar to the emitters 131, 144 described above. The multicolor portion 158 is a multicolor emitter such as that described above for FIG. 3.

The multicolor portion 158 changes colors to indicate safe, warning, or fail conditions.

The fifth, sixth, and seventh subdisplays 137–139 are warning indicators including block emitters 108 having the serpentine pattern shown in FIG. 5. The sixth subdisplay 138 is active to backlight opaque text 160 indicating the warning condition "FUEL LOW."

While the display assembly 130 as presented in FIG. 6 is configured for use as an automobile navigation and safety panel, one skilled in the art will recognize various other combinations of application specific displays with or without the conventional emitter array 132. For example, the conventional emitter array 132 may be a display screen for a personal computer and the subdisplays 133–139 can provide various operating information, such as battery level, modem connection or similar features. Similarly, the subdisplays 133–139 can be rearranged to form an automobile dashboard panel or stereo control panel. Alternatively, the conventional array 132 may be a portion of a touch screen display and the subdisplays 133–139 can indicate touch locations for activating specific features or for providing input.

While the present invention has been presented by way of exemplary embodiments, one skilled in the art will recognize several modifications which may be within the scope of the invention. Accordingly, the invention is not limited except as by the appended claims.

We claim:

1. An application specific field emission display for emitting light according to a predefined image formed by one or more image portions, comprising:

a substrate;

an extended first linear emitter, the first emitter having a substantially contiguous emissive first discontinuity defining a first line having a first path corresponding to a first one of the image portions;

an extraction grid carried by the substrate, the extraction grid including a plurality of edges defining an extended first gap extending along the first line; and a first signal terminal coupled to drive the first emitter.

2. The emitter panel of claim 1 wherein the predefined image includes a graphical, geometric or textual image portion and the first line is a segment of the graphical, geometric, or textual image.

3. The emitter panel of claim 1, further including an integrated control circuit having a first output coupled to the first emitter.

4. The emitter panel of claim 1 wherein the predefined image is formed from a plurality of image portions, further including:

an extended second emitter, the second emitter having a substantially contiguous emissive second discontinuity defining a second line having a second path corresponding to a second one of the image portions; and a second terminal coupled to drive the second emitter, wherein the plurality of edges further defines a second extended gap extending along the second line.

5. The emitter panel of claim 4 wherein the first and second lines form portions of a multisegment display.

6. The emitter panel of claim 5 wherein the first and second portions are substantially adjacent linear regions forming a contiguous region.

7. The emitter panel of claim 1 wherein each of the first and second lines is a straight line, further including a linking line linking the first and second lines such that the first line, the second line and the linking line together form a linked, nonlinear pattern.

8. The emitter panel of claim 7 wherein the linked, nonlinear pattern is a serpentine pattern.

9. A field emission display for producing an image having a defined pattern, comprising:

a display screen having a cathodoluminescent layer;

an extended first emitter aligned to the display screen, the first emitter having a substantially contiguous emissive discontinuity defining a first line, the first line following a first portion of the defined pattern;

an extended second emitter aligned to the display screen, the second emitter having a substantially contiguous emissive discontinuity defining a second line, the second line following a second portion of the defined pattern; and an integrated control circuit coupled to control electron emission from the first and second emitters.

10. The display of claim 9 wherein the control circuit includes a first output coupled to the first emitter and a second output separately coupled to the second emitter.

11. The display of claim 10 wherein the cathodoluminescent layer includes a first section of a material selected to emit light at a first wavelength aligned to the first line and a second section of a material selected to emit light at a second wavelength different from the first wavelength aligned to the second line.

12. The display of claim 11 wherein the first line is a straight line and the second line is a straight line parallel to the first line and wherein each of the emitters is configured for separate control by the control circuit.

13. The display of claim 12, further including:

a third extended emitter aligned to the display screen, the third emitter having a substantially contiguous emissive discontinuity defining a third line, the third line following a third portion of the defined pattern; and wherein the cathodoluminescent layer includes a third section aligned to the third line, the third section including a material selected to emit light at the third wavelength different from the first and second wavelengths.

14. The display of claim 13 wherein the first, second and third lines include substantially adjacent regions wherein the control circuit includes red, green and blue outputs coupled to the first, second and third emitters, respectively.

15. The display of claim 9 wherein the image is a graphical, geometric or textual image.

16. The display of claim 9 wherein the first and second emitters form discrete segments of a multi-segment display.

17. The display of claim 16, further including third, fourth, fifth, sixth and seventh extended emitters, each of the first through seventh emitters being positioned to form a segment of the multi-segment display, each of the emitters configured for separate activation by the control circuit.

18. A field emission display for producing an image having a predefined pattern and a graphical, video or textual image portion, comprising:

a display screen having a cathodoluminescent layer;

a plurality of extended emitters aligned to a first section of the display screen, each of the extended emitters having an emissive discontinuity defining a respective line, each line defining a portion of the predefined pattern; and a matrix addressable array of emitters aligned to a second section of the display screen, the array of emitters being arranged in rows and columns.

19. The display of claim 18 wherein the plurality of extended emitters and the array of emitters are integrated into a common substrate.

20. The display of claim 18 wherein the extended emitters are arranged as segments of a multi-segment indicator.

21. The display of claim 18 wherein the plurality of extended emitters are linked to form a serpentine emitter.

22. A method of displaying information with a field emission display having a cathodoluminescent layer, comprising:

selecting a first section of the cathodoluminescent layer defining a first substantially line portion of an image;

producing a first linear image portion by activating the first section of the cathodoluminescent layer with a first extended emitter;

selecting a second section of the cathodoluminescent layer defining a second substantially linear portion of the image;

producing a second linear image portion by activating the second section of the cathodoluminescent layer with a second extended emitter different from the first extended emitter;

selecting a third section of the cathodoluminescent layer defining a matrix addressable array; and activating selected emitters in the matrix addressable array to produce video, graphical, or textual information.

23. The method of claim 22 wherein the information is color information, further including:

selecting a third section of the cathodoluminescent layer defining a third substantially linear portion of the image; and activating the third section of the cathodoluminescent layer with a third extended emitter different from the first and second extended emitters, wherein the first, second and third sections of cathodoluminescent layer include red, green and blue emissive material, respectively.

24. An application specific field emission display for emitting light according to at least one predefined application specific graphical, geometric, or textual image, comprising:

a substrate;

an extended first linear emitter, the first emitter having a single substantially contiguous emissive first discontinuity defining a first line having a first path corresponding to a first one of the at least one predefined application specific graphical, geometric, or textual image;

an extraction grid carried by the substrate, the extraction grid including a plurality of edges defining an extended first gap extending along the first line; and a first signal terminal coupled to drive the first emitter.

25. The emitter panel of claim 24, further comprising:

an extended second emitter, the second emitter having a single substantially contiguous emissive second discontinuity defining a second line having a second path corresponding to a second one of the at least one predefined application specific graphical, geometric, or textual image; and a second terminal coupled to drive the second emitter, wherein the plurality of edges further defines a second extended gap extending along the second line.

26. The emitter panel of claim 25, wherein the first and second predefined application specific graphical, geometric, or textual images form portions of a composite graphical, geometric, or textual image.

27. The emitter panel of claim 26, wherein the first and second lines are substantially adjacent linear regions forming a continuous region.

28. A method of displaying information with a field emission display having a cathodoluminescent layer, comprising:

activating a first one of a number of extended emitters, the first extended emitter having a substantially contiguous emission discontinuity corresponding in shape to a first graphic, geometrical or textual image; and activating a second one of a number of extended emitters, the second extended emitter having a substantially contiguous emission discontinuity corresponding in shape to a second graphic, geometrical or textual image.

29. The method of claim 28 wherein the first geometrical image is color, and further including:

activating a third one of a number of extended emitters, the third extended emitter having a substantially contiguous emission discontinuity corresponding in shape to a first graphic, geometrical or textual image, wherein the first extended emitter is aligned to activate a first section of a cathodoluminescent layer of a first color and the third extended emitter is aligned to activate a second section of the cathodoluminescent layer of a second color.

* * * * *

UNITED STATES PATENT AND TRADEMARK OFFICE

CERTIFICATE OF CORRECTION

PATENT NO. : 5,986,625
DATED : November 16, 1999
INVENTOR(S) : Huang, et. al.

It is certified that error appears in the above-identified patent and that said Letters Patent is hereby corrected as shown below:

| | | |
|---|---|---|
| Column 4, line 16 | "Layer 112" | - - Layer 122 - - |
| Column 5, line 55 | "the display" | - - The display - - |

Signed and Sealed this

First Day of May, 2001

*Attest:*

Nicholas P. Godici

NICHOLAS P. GODICI

*Attesting Officer*

*Acting Director of the United States Patent and Trademark Office*